US005181283A

United States Patent [19]

Gillebaard

[11] Patent Number: 5,181,283

[45] Date of Patent: Jan. 26, 1993

[54] COLLAPSIBLE SKIMMER

[76] Inventor: Hendrik C. Gillebaard, 22192 Paso del Sur, South Laguna Beach, Calif. 92677

[21] Appl. No.: 650,768

[22] Filed: Feb. 4, 1991

Related U.S. Application Data

[63] Continuation-in-part of Ser. No. 566,146, Aug. 9, 1990, Pat. No. 5,083,327.

[51] Int. Cl.[5] ..... E04H 4/00

[52] U.S. Cl. ..... 4/496; 4/507

[58] Field of Search ..... 4/490, 496, 506, 512; 210/169, 416.2

[56] References Cited

U.S. PATENT DOCUMENTS

| | | | |
|---|---|---|---|
| 1,664,887 | 4/1928 | Kirkham et al. | 52/169.7 |
| 1,753,427 | 4/1930 | Phillips | 4/507 |
| 2,378,159 | 6/1945 | Royer | 220/9.1 |
| 2,483,789 | 10/1949 | Smith et al. | 4/506 |
| 3,225,362 | 12/1965 | Barrera | 4/506 |
| 3,443,263 | 5/1969 | Minasy | 4/506 |
| 3,815,160 | 6/1974 | Baker | 4/510 |
| 4,356,933 | 11/1982 | Connolly | 220/401 |
| 4,426,286 | 1/1984 | Puckett et al. | 210/169 X |
| 4,890,343 | 1/1990 | Schlags | 4/585 |
| 4,989,751 | 2/1991 | Gillett | 220/565 |

FOREIGN PATENT DOCUMENTS

| | | | |
|---|---|---|---|
| 1123409 | 9/1956 | France | 4/506 |
| 478106 | 8/1975 | U.S.S.R. | 4/506 |
| 1037127 | 7/1966 | United Kingdom | 4/506 |

*Primary Examiner*—Henry J. Recla
*Assistant Examiner*—Robert M. Fetsuga
*Attorney, Agent, or Firm*—Stetina and Brunda

[57] ABSTRACT

This invention relates to a collapsible skimmer for use with various currently known above-the-ground pools. The skimmer generally comprises a flexible enclosure which is adapted to be secured to a side wall of the flexible liner of the pool. Disposed within the enclosure is a conventional weir basket having a weir gate attached thereto. The weir basket is operable to provide structural rigidity to the enclosure when disposed therewithin. When the weir basket is removed from the interior of the enclosure, the flexible nature of the enclosure allows it to be collapsed together with the pool liner.

6 Claims, 1 Drawing Sheet

COLLAPSIBLE SKIMMER

FIELD OF THE INVENTION

The present invention is a continuation-in-part patent application of pending application Ser. No. 07/566,146, filed Aug. 9, 1990, now U.S. Pat. No. 5,083,327 entitled PORTABLE SWIMMING POOL, the disclosure of which is expressly incorporated herein by reference. The present invention relates generally to swimming pools, and more particularly to a collapsible skimmer for attachment to an above-the-ground swimming pool.

BACKGROUND OF THE INVENTION

A common component of both above-the-ground and built-in swimming pools and/or spas is a mechanism known as a skimmer. A skimmer generally comprises a device for removing floating debris from the water surface of a pool or spa. Typically, skimmers utilize a strainer or weir basket disposed in a chamber located adjacent to and in fluid communication with the water level within the swimming pool. The pool water enters the chamber through an inlet port disposed within a side wall of the pool. The chamber further includes an outlet port which is in turn connected to a filter/pump assembly. The weir basket is typically positioned over the outlet port such that water entering the chamber will pass through the weir basket before exiting through the outlet port. In this respect, the weir basket serves as a large element filtering mechanism whereby materials which enter the pool and float upon the water surface, such as grass, leaves, insects, etc. are removed from and filtered out of the water. Thus, as can be appreciated, the skimmer plays an important role in keeping the pool water surface free from contaminants and debris.

Many varieties of above-the-ground swimming pools are known in the art. Typically, such pools are constructed from flexible liners which are supported by rigid frames which may be assembled and in some instances disassembled. Because of the pliable, flexible nature of the water retaining liners of currently known above-the-ground pools, such pools are not well suited to have skimmers attached thereto. In this respect, skimmers as currently known are fabricated from rigid structural components which are not adapted to be secured to a non-rigid structure, such as a flexible liner. Additionally, because of the rigid construction of currently known skimmers, the attachment and removal of such skimmers from the pool would necessarily involve a difficult and time-consuming procedure since the skimmer could not simply be collapsed along with the liner. As such, currently known above-the-ground pools are generally not able to obtain the filtering effects that a skimmer provides. Thus, there exists a need in the art for a collapsible skimmer which may be attached to and used in conjunction with such pools.

SUMMARY OF THE INVENTION

In accordance with the preferred embodiment of the present invention there is provided a collapsible skimmer for use with an above-the-ground swimming pool. The skimmer generally comprises a flexible enclosure which defines an interior chamber having an upper portion and a lower portion. The enclosure is adapted to be positionable over an inlet port formed within a side wall of the pool such that the lower portion of the interior chamber is in fluid communication with the water contained within the pool. An outlet port is disposed within the enclosure, the outlet port being in fluid communication with the lower portion of the interior chamber. Disposed within the lower portion of the interior chamber is a weir basket which is adapted to provide structural support to the enclosure. The weir basket is positionable over the outlet port in a manner wherein water entering the enclosure will pass through the weir basket and out the outlet port.

The weir basket includes a weir gate attached thereto which is articulable between an open position and a closed position. In this respect, the weir gate is operable to obstruct the inlet port when in the closed position and allow water to circulate freely through the inlet port and the interior chamber when in the open position. The weir gate, which is normally in the closed position, moves to the open position when water is pulled through the outlet port by a suction pump. The present invention further comprises a retention sleeve mounted to the side wall of the pool, the retention sleeve being adapted to secure a hose extending from the outlet port to the suction pump against the pool side wall. In the preferred embodiment, the enclosure is constructed from polyester fabric coated with waterproof vinyl material.

BRIEF DESCRIPTION OF THE DRAWINGS

These as well as other features of the present invention will become apparent upon reference to the drawings wherein.

DETAILED DESCRIPTION OF THE PREFERRED EMBODIMENT

Figure 1:
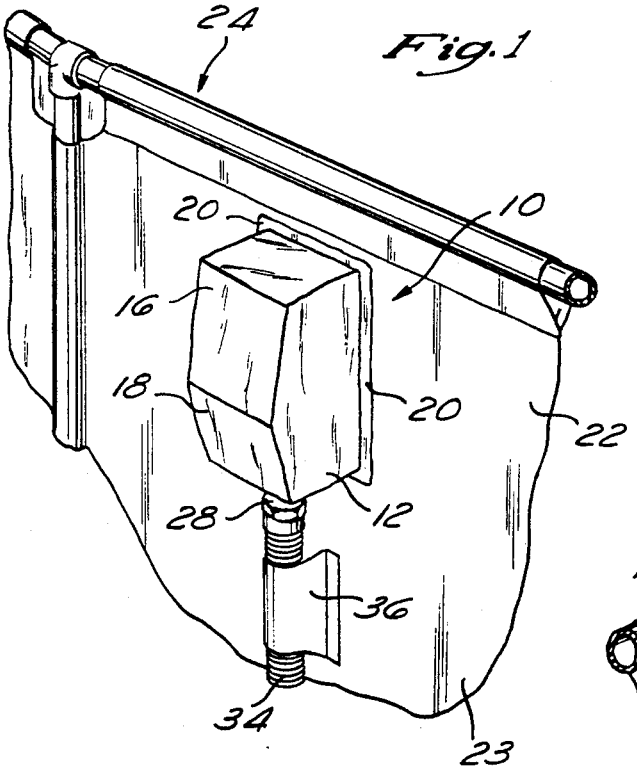
FIG. 1 is a perspective view of the skimmer of the present invention as seen attached to the exterior of the pool side wall.

Referring now to the drawings wherein the showings are for purposes of illustrating a preferred embodiment of the present invention only, and not for purposes of limiting the same, FIG. 1 perspectively illustrates a collapsible skimmer 10 of the present invention. Skimmer 10 generally comprises an enclosure 12 defining an interior chamber 14 having an upper portion 16 and a lower portion 18. Skimmer 10 is preferably utilized in conjunction with portable swimming pools, and particularly portable swimming pools of the type disclosed in pending application Ser. No. 07/566,146, filed Aug. 9, 1990 by the subject applicant, entitled PORTABLE SWIMMING POOL, the disclosure of which is incorporated herein by reference.

Figure 4:
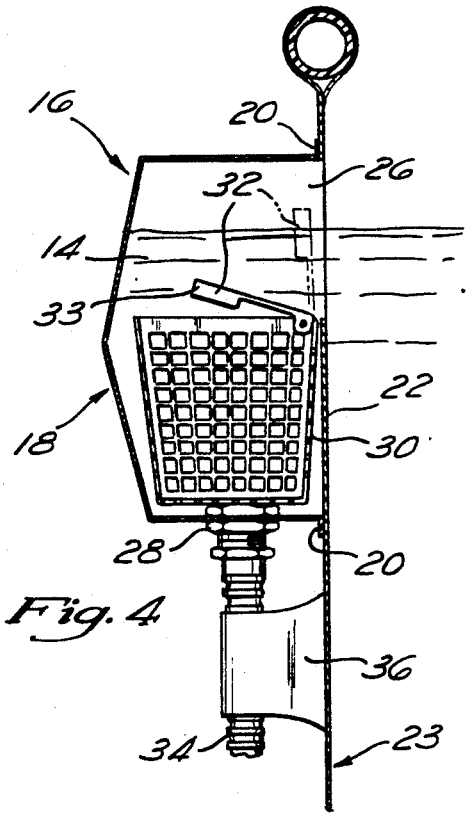
FIG. 4 is a cross-sectional view taken along line 4—4 of FIG. 2.

As best seen in FIGS. 1 and 4, disposed about the periphery of enclosure 12 is a laterally extending flange 20. Importantly, flange 20 is used to secure enclosure 12 to the side wall 22 of the flexible liner 23 used to construct the portable pool 24. The side wall 22 of liner 23 is preferably constructed from polyester fabric coated with water-proof vinyl. Enclosure 12 as well as flange 20 which is an integral portion thereof, are also preferably constructed from a flaccid material such as polyester coated With water-proof vinyl. In this respect, enclosure 12 is attached to liner 23 by heat-sealing flange 20 to side wall 22. It will be appreciated that in instances wherein side wall 22 is constructed from a material other than one which is compatible for such a heat-sealing process, alternative means, such as adhesives, may be utilized to secure flange 20 and hence enclosure 12 thereto.

In the preferred embodiment, enclosure 12 is adapted to be positionable over an inlet port 26 disposed within side wall 22 in a manner such that a substantial part of the upper portion 16 and the entire lower portion 18 of interior chamber 14 are in fluid communication with the water contained within liner 23. Disposed within enclosure 12 is an outlet port 28 which is in fluid communication with lower portion 18 of interior chamber 14.

Figure 2:
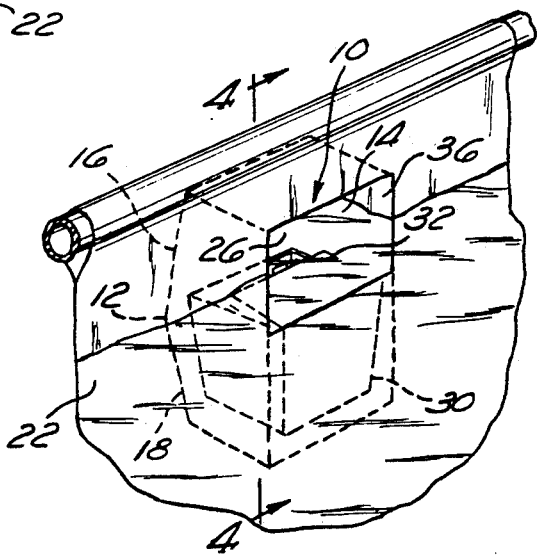
FIG. 2 is a perspective view of the skimmer as seen from the interior of the pool side wall.
Figure 3:
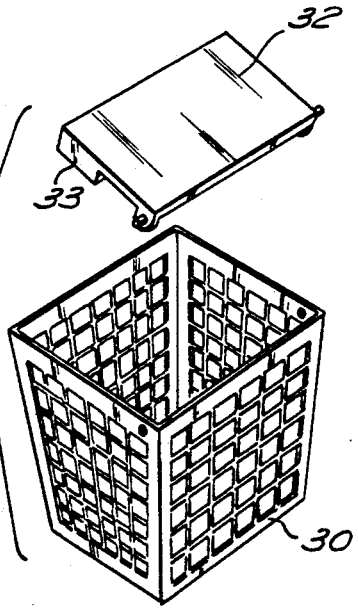
FIG. 3 is an exploded view of the weir basket and weir gate of the skimmer.

Referring now to FIGS. 2–4, disposed within lower portion 18 of interior chamber 14 is a weir basket 30. Advantageously, weir basket 30 is adapted to provide structural support to enclosure 12 when disposed therewithin. When disposed within lower portion 18, Weir basket 30 is positioned over outlet port 28 in a manner wherein water entering enclosure 12 will pass through weir basket 30 and out of outlet port 28. Weir basket 30 further includes a weir gate 32 attached thereto which is articulable between an open position and a closed position (as seen in FIG. 4). When in the closed position (shown in phantom), weir gate 32 is operable to create an obstruction between inlet port 26 and interior chamber 14. When in the open position, weir gate 32 allows water to circulate freely through inlet port 26 and interior chamber 14. Importantly, weir gate 32 is adapted to be normally in the closed position and is maintained in the closed position by means of a float device 33 disposed on the end thereof. Weir gate 32 is attached to weir basket 30 in a manner such that when water is pulled through outlet port 28 by a conventional suction pump filter assembly (not shown), the movement of the water through inlet port 26 and interior chamber 14 will pull weir gate 32 downwardly towards the open position. As seen in FIG. 4, when weir gate 32 is in the open position, water is able to circulate over the top of weir gate 32 and through weir basket 30. During operation of skimmer 10, weir basket 30 is able to filter elements, such as grass, leaves, insects, etc., from the pool water as the water is being circulated therethrough. As can be appreciated, the manner in which weir gate 32 operates is such that it will be in the open position only when the suction pump is activated, which would only occur at those times when the pool 24 is in use. Thus, when the pool 24 is not being used, weir gate 32 assumes the closed position thereby preventing objects that have been gathered within weir basket 30 from flowing back into the pool 24 through inlet port 26, since such would occur due to the absence of the suction face to retain the objects within the weir basket 30. Weir basket 30 is placed within interior chamber 14 subsequent to the attachment of enclosure 12 to side wall 22. In this respect, weir basket 32 is placed within lower portion 18 through inlet port 26. Weir basket 30 is emptied by removing it from interior chamber 14 by way of inlet port 26. As previously specified, weir basket 30 provides structural rigidity to enclosure 12 when placed therewithin. In this respect, the placement of the weir basket 30 into the lower portion 18 of enclosure 12 prevents the lower portion 18 from collapsing against the side wall 22 of flexible liner 23. As seen in FIG. 4, the upper portion 16 of enclosure 12 is prevented from collapsing toward the inlet port 26 of side wall 22 by the volume of water received therein and by the top end of the weir basket 30. As can be appreciated, due to the flexible construction of enclosure 12, when weir basket 30 is removed therefrom, enclosure 12 may be collapsed along with liner 23 when the pool 24 is disassembled and stored.

As previously specified, outlet port 28 is connected to a conventional suction pump (not shown), which forms a portion of a conventional filter/recirculation system for the pool. The connection of outlet port 28 to the suction pump is facilitated by a hose 34 as seen in FIGS. 1 and 4. In this respect, a retention sleeve 36 is mounted to side wall 22, the retention sleeve being adapted to secure hose 34 against side wall 22. Retention sleeve 36, like enclosure 12, is also preferably constructed from polyester coated with water-proof vinyl and is also secured to side wall 22 by a heat-sealing process.

Additional modifications and improvements of the present invention may also be apparent to those skilled in the art. Thus, the particular combination of parts described and illustrated herein is intended to represent only one embodiment of the invention, and is not intended to serve as limitations of alternative devices within the spirit and scope of the invention.

What is claimed is:

1. A collapsible skimmer for use within an above-the-ground swimming pool comprising:

a flexible, collapsible, flaccid enclosure defining an interior chamber having an upper portion and a lower portion, said enclosure being sized to be positionable over an inlet port disposed within a side wall of said pool and attachable to said side wall such that a substantial part of said upper portion and all of said lower portion of said interior chamber are in constant fluid communication with water contained within said pool;

an outlet port disposed within said enclosure, said outlet port being in fluid communication with said lower portion of said interior chamber; and a weir basket disposed within said lower portion of said interior chamber, said weir basket being formed to provide structural support to said enclosure and being positionable over said outlet port in a manner wherein water entering said enclosure will pass through said weir basket and out said outlet port.

2. The device of claim 1 wherein said weir basket includes a weir gate attached thereto articulable between an open position and a closed position, said weir gate being operable to block said inlet port when in said closed position and allow water to enter said interior chamber when in said open position.

3. The device of claim 2 wherein said weir gate is normally in said closed position, said weir gate moving to said open position when water is pulled through said outlet port by a suction pump.

4. The device of claim 3 further comprising a flexible retention sleeve used in combination with the flexible enclosure, said retention sleeve adapted to being mounted to said side wall and adapted to secure a hose extending from said outlet port to said suction pump against said side wall.

5. The device of claim 1 wherein said enclosure is constructed from polyester coated with water-proof vinyl.

6. A collapsible skimmer for use with an above-the-ground swimming pool having a flexible liner, said skimmer comprising:

a flexible, collapsible enclosure defining an interior chamber having an upper portion and a lower portion;

a laterally extending flange disposed about the periphery of said enclosure, said enclosure being sized to be positionable over an inlet port disposed within a side wall of said liner and adapted tc be attached to said liner via the heat-sealing of said flange thereto such that a substantial part of said upper portion and all of said lower portion of said interior chamber are constant fluid communication with water contained within said liner;

an outlet port disposed within said enclosure, said outlet port being in fluid communication with said lower portion of said interior chamber; and a weir basket disposed within said lower portion of said interior chamber, said weir basket being formed to provide structural support to said enclosure and being positionable over said outlet port in a manner wherein water entering said enclosure will pass through said weir basket and out said outlet port.

* * * * *